United States Patent [19]

Hawkins et al.

[11] 3,995,951

[45] Dec. 7, 1976

[54] SHEET FEEDING APPARATUS AND REPRODUCING MACHINE

[75] Inventors: David N. Hawkins, Victor; Thomas Acquaviva, Penfield, both of N.Y.

[73] Assignee: Xerox Corporation, Stamford, Conn.

[22] Filed: Mar. 26, 1975

[21] Appl. No.: 562,280

[52] U.S. Cl. ..... 355/3 R; 355/4; 355/24; 96/1.5

[51] Int. Cl.[2] ..... G03G 15/00

[58] Field of Search ..... 355/3 TR, 3 R, 4, 3 DR, 355/17, 16, 24, 13; 346/138

[56] References Cited

UNITED STATES PATENTS

| | | | |
|---|---|---|---|
| 3,495,271 | 2/1970 | Clift et al. | 346/138 |
| 3,588,242 | 6/1971 | Berlier et al. | 355/16 |
| 3,750,573 | 8/1973 | Haeusler et al. | 355/16 |
| 3,829,208 | 8/1974 | Van Meijel et al. | 355/3 DR |

*Primary Examiner*—R. L. Moses
*Attorney, Agent, or Firm*—Paul Weinstein; Clarence A. Green; James J. Ralabate

[57] ABSTRACT

A sheet feeding apparatus and process wherein a movable member having a sheet receiving surface on its outer periphery includes a cavity. A supply of sheet material is supported within the cavity and feeding means are provided for feeding the sheet material outwardly from the cavity for application to the surface of the movable member. Preferably the sheet receiving surface comprises an electrostatic imaging surface. The process and apparatus may be applied to reproducing machines and processes for forming images on a single side of a sheet; on both sides of a sheet in a single pass; or for forming plural images in superimposed registration on a sheet.

15 Claims, 12 Drawing Figures

FIG. 3
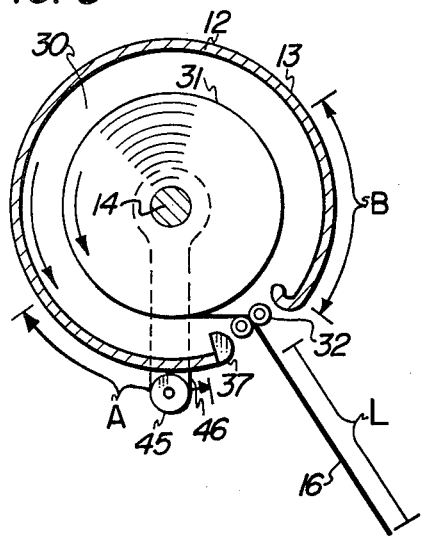
FIG. 6
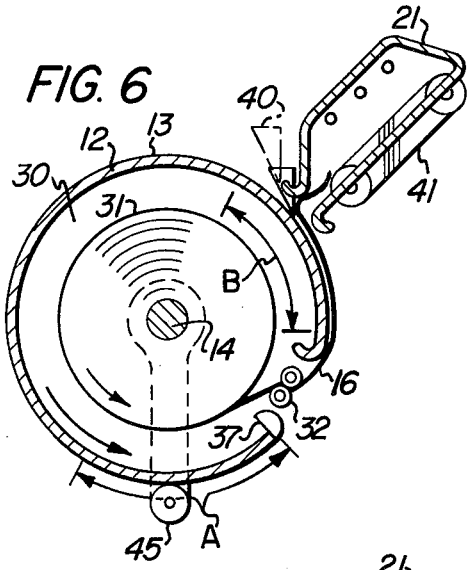
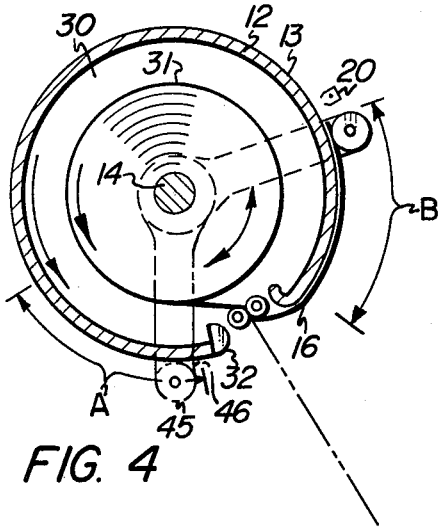
FIG. 4
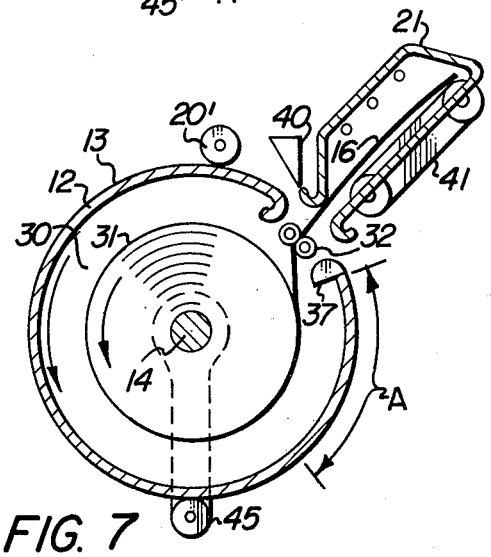
FIG. 7
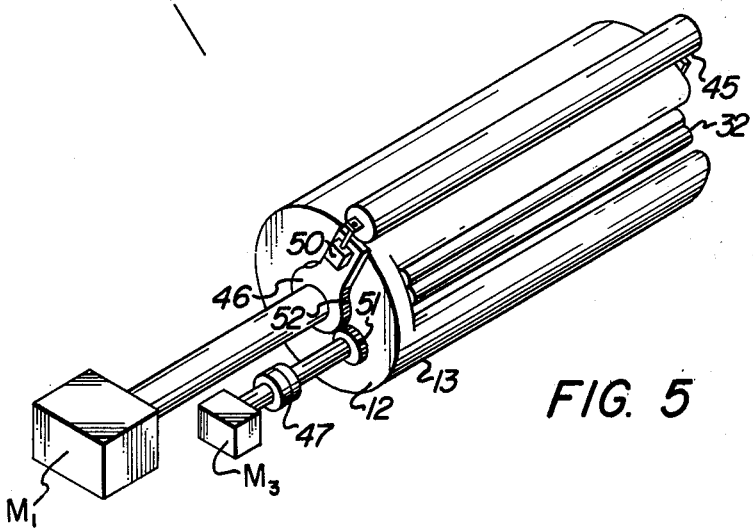
FIG. 5

FIG. 8
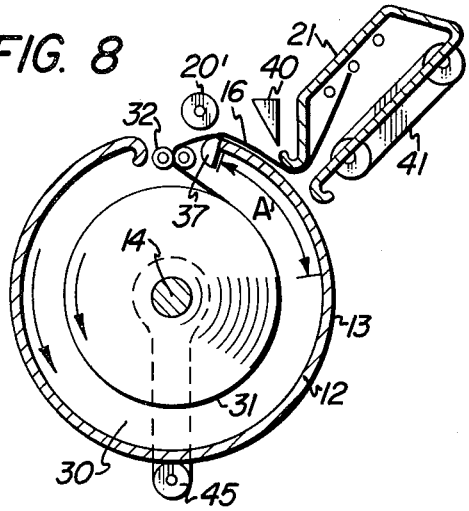
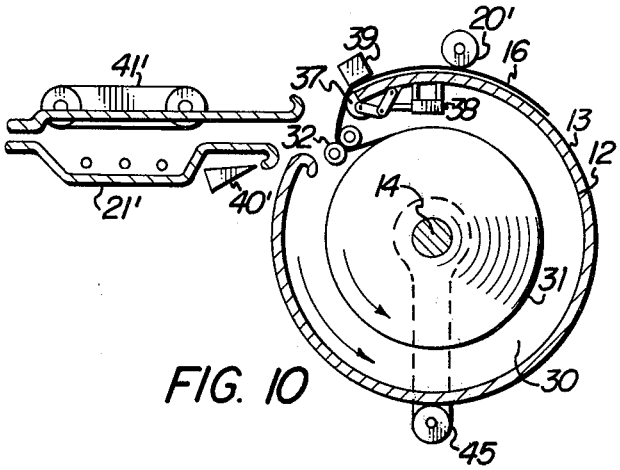
FIG. 10
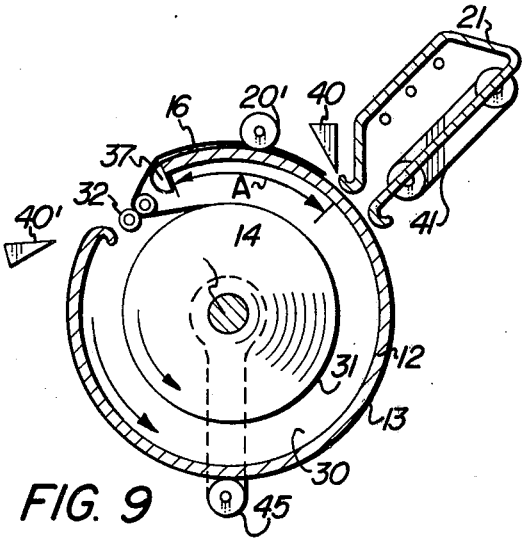
FIG. 9
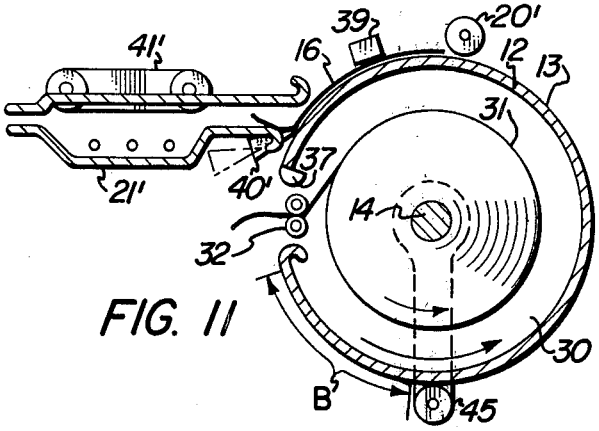
FIG. 11
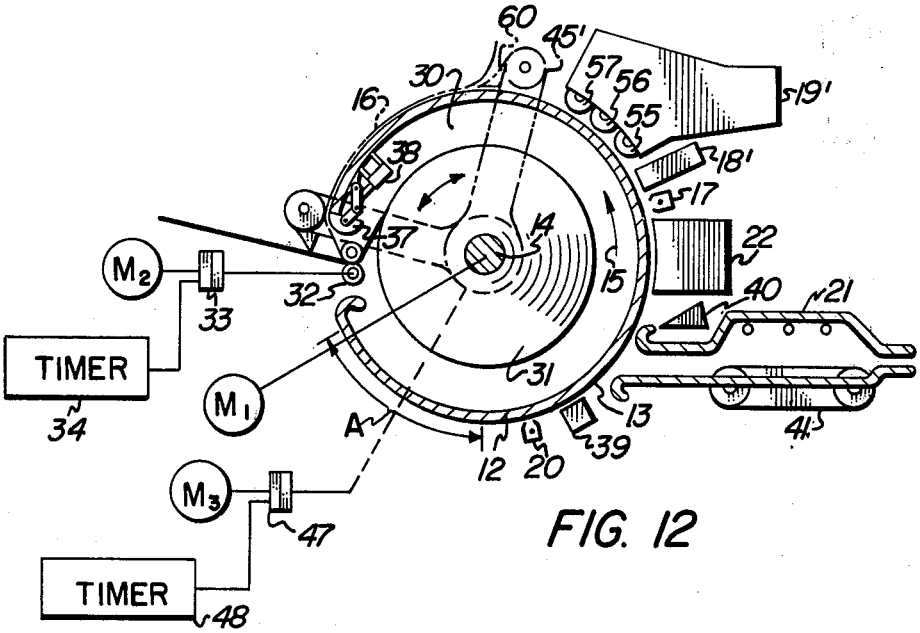
FIG. 12

SHEET FEEDING APPARATUS AND REPRODUCING MACHINE

BACKGROUND OF THE INVENTION

This invention relates to a sheet feeding apparatus for a reproducing machine and to improved reproducing machines utilizing the sheet feeding apparatus.

It is well known to supply sheets of final support material to an imaging device of a reproducing machine from a roll of such material. For example, note U.S. Pat. Nos. 3,504,586 to Acquaviva and 3,639,053 to Spear. Conventionally, the sheet material is fed from the roll and then severed into a sheet of a desired length. The sheet which is cut from the roll is then registered with the imaging device which forms an image on the sheet either by transfer or direct development. The use of a roll of final support material eliminates the need to have a sheet separator as would be required if one were feeding cut sheets from a stack of such sheets. However, after the sheet has been cut from the roll supply, it may have to be registered with the image which is to be transferred to it.

It is also known in the prior art to support photosensitive material in web form internally of a drum-like imaging member. The photosensitive web is supported about the periphery of the drum and is periodically replaced or advanced by feeding new web material from inside the drum to the outer periphery thereof. The original web material is disposed of either by recoiling it within the drum or by cutting it off and feeding it away from the drum surface, as shown in U.S. Pat. No. 3,829,208 to van Meijel et al.

The apparatus of this invention is particularly suited for use in a reproducing machine adapted to provide duplexed copies, namely, copies which have been imaged on both sides of the sheet. A wide variety of reproducing machines using an electrostatographic process have been developed which are capable of forming images on both sides of a copy sheet. Illustrative of these machines are those set forth in U.S. Pat. Nos. 3,227,444; 3,318,212; 3,506,347; 3,580,670; 3,615,129; 3,645,615; 3,672,765; 3,687,541; and 3,697,170.

A particularly advantageous duplexing type reproduction machine is described in U.S. Patent application Ser. No. 411,996 filed Nov. 1, 1973 now U.S. Pat. No. 3,947,270, to North for a reproducing apparatus and process for duplex imaging in a single pass. In accordance with the invention disclosed in that application a reproducing apparatus is provided for duplexing in a single pass. The apparatus includes a moving photosensitive surface; means for forming sequential images on that surface; and means for transferring the images to the first and opposing side of a copy sheet. The transfer means includes means for securing the trailing edge of the sheet to the imaging surface and means for pivoting the sheet about the surface.

The apparatus of the present invention is uniquely adaptable to a duplexing machine as set forth in the above-noted application.

SUMMARY OF THE INVENTION

In accordance with this invention a unique feeding arrangement is provided as well as a variety of reproducing machines utilizing such a sheet feeding arrangement. The apparatus of this invention includes a movable member having a surface on its outer periphery adapted to move past a plurality of work stations for forming an image on a sheet of final support material. The member includes a cavity and a supply of final support material is supported within the cavity. Means are provided for feeding the support material out from within the cavity so that it may be applied against the peripheral surface.

The reproducing machines in addition to the aforenoted sheet feeding arrangement include means for forming an image on the sheet of final support material. Preferably the peripheral surface comprises an imaging surface and means are provided for transferring an image from the imaging surface to the final support material. The reproducing apparatus may be adapted for forming a copy on one side of the sheet of final support material or for copying on both sides of the sheet. In accordance with yet another embodiment plural toner images may be transferred to the sheet of final support material to provide a copy, if desired, in more than one color.

The supply of final support material is preferably in the form of a roll and the sheet feeding apparatus preferably includes a means for severing the final support sheet from the supply roll after the image or images have been formed thereon.

The process of feeding sheets from the interior of an imaging member for application to its outer periphery and reproducing processes employing such a sheet feeding process also form a part of the present invention.

Accordingly, it is an object of this invention to provide a sheet feeding apparatus and process wherein sheet material is fed from a supply internally of a moving member to the peripheral surface thereof for forming an image on the sheet.

It is a further object of this invention to provide reproducing apparatuses and processes employing the above-noted sheet feeding apparatus and process.

It is a further object of this invention to provide a reproducing apparatus and process as above wherein the sheet is imaged on both sides in a single pass.

It is a still further object of this invention to provide a reproducing apparatus and process as above wherein plural toner images are transferred to the sheet.

These and other objects will become more apparent to those skilled in the art from the following description and drawings.

BRIEF DESCRIPTION OF THE DRAWINGS

FIG. 3 is a partial schematic view of the machine of FIG. 2 during the sheet feeding cycle.

FIG. 4 is a partial schematic view of the apparatus of FIG. 2 showing the first sheet application and image transfer.

FIG. 5 is a partial perspective view of the apparatus of FIG. 2 showing the applicator roller mechanism.

FIG. 6 is a partial schematic view of the apparatus of FIG. 2 showing sheet stripping for fusing.

FIG. 7 is a partial schematic view of the apparatus of FIG. 2 showing the first fusing cycle.

FIG. 8 is a partial schematic view of the apparatus of FIG. 2 showing the application of the second side of the sheet to the second image on the drum.

FIG. 9 is a partial schematic view of the apparatus of FIG. 2 showing transfer of the second image to the second side of the sheet.

FIG. 10 is a partial schematic view of the apparatus of FIG. 2 showing the severing of the sheet from the supply roll.

FIG. 11 is a partial schematic view of the apparatus of FIG. 2 showing the second stripping and fusing cycle.

FIG. 12 is a schematic representation of a reproducing machine in accordance with yet another embodiment adapted to transfer plural toner images to the sheet.

DETAILED DESCRIPTION OF THE PREFERRED EMBODIMENTS

In accordance with this invention a unique sheet feeding apparatus 10 is provided which eliminates both the need for sheet separation, skew correction and registration. The apparatus of this invention saves machine space by elimination of the conventional sheet feeder and registration system. Registration is automatically provided by feeding the sheet from a roll for a fixed time interval corresponding to a desired sheet length. It is possible with the sheet feeding apparatus 10 which will be described hereinafter to the image up to the very edge of the sheet with no loss of information and no gripper marks. This is a substantial advantage as compared to prior art approaches utilizing, for example, gripper mechanisms wherein a leading or trailing edge deletion can result. A further advantage of the apparatus of this invention is a reduction in the propensity for jamming because the sheet during formation of the images thereon is continuously held by the sheet feeding apparatus and remains attached to the supply roll.

Figure 1:
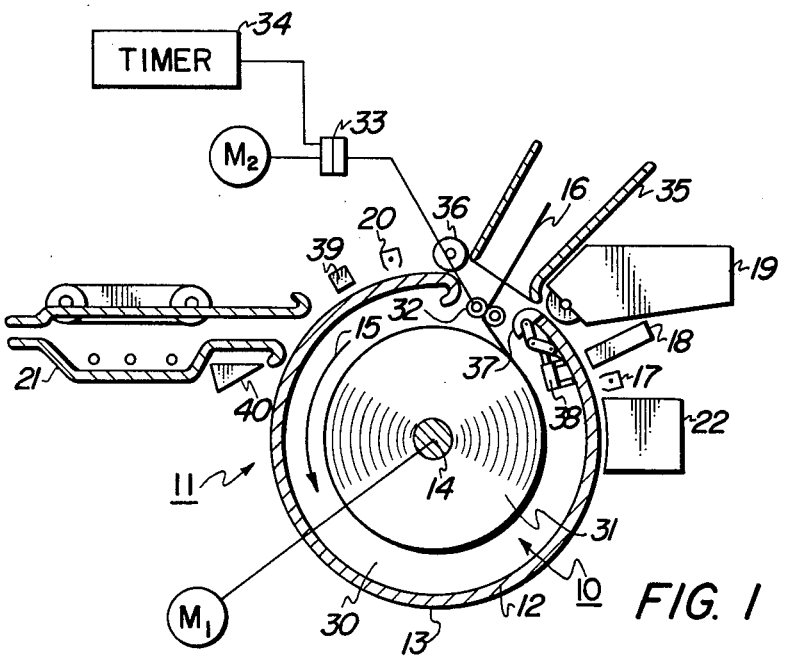
FIG. 1 is a schematic illustration of a reproducing machine adapted to form images on a single side of a sheet of final support material.

Referring now to FIG. 1 there is shown by way of example an automatic xerographic reproducing machine 11 which incorporates the sheet feeding apparatus 10 of the present invention. The reproducing machine 11 depicted in FIG. 1 illustrates the various components utilized therein for producing copies from an original. Although the sheet feeding apparatus 10 of the present invention is particularly well adapted for use in an automatic xerographic reproducing machine 11, it should become evident from the following description that it is equally well suited for use in a wide variety of processing systems including other electrostatographic systems and it is not necessarily limited in its application to the particular embodiment or embodiments shown herein.

Figure 2:
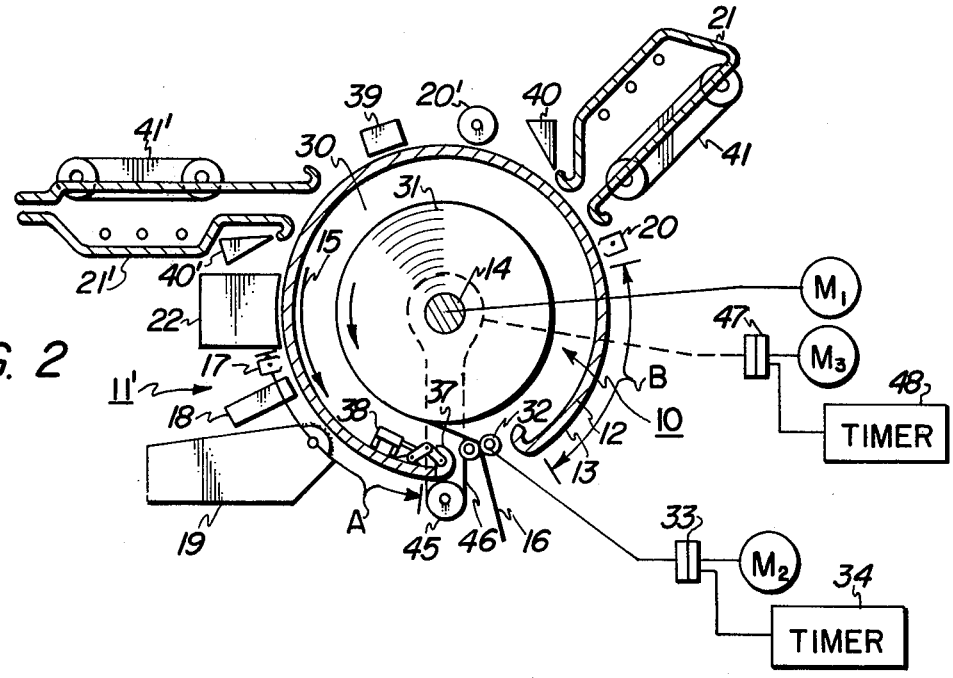
FIG. 2 is a schematic representation of a reproducing apparatus in accordance with the present invention adapted to form images of both sides of the sheet.

The reproducing machine 11 illustrated in FIG. 2 employs an image recording drum-like member 12, the outer periphery of which is coated with a suitable photoconductive material 13. One type of suitable photoconductive material is disclosed in U.S. Pat. No. 2,970,906, issued to Bixby in 1961. The drum 12 is suitably journaled for rotation within a machine frame (not shown) by means of shaft 14 and rotates in the direction indicated by arrow 15 to bring the image-bearing surface 33 thereon past a plurality of xerographic processing stations. Suitable drive means M1 are provided to power and coordinate the motion of the various cooperating machine components whereby a faithful reproduction of the original input scene information is recorded upon a sheet of final support material 16 such as paper or the like.

The practice of xerography is well known in the art and is the subject of numerous patents and texts including *Electrophotography* by Schaffert, published in 1965, and *Xerography and Related Processes* by Dessauer and Clark, published in 1965.

Initially, the drum 12 moves the photoconductive surface 13 through a charging station 17. In the charging station 17, an electrostatic charge is placed uniformly over the photoconductive surface 13 preparatory to imaging. The charging may be provided by a corona generating device of the type described in U.S. Pat. No. 2,836,725, issued to Vyverberg in 1958.

Thereafter, the drum 12 is rotated to exposure station 18 wherein the charged photoconductive surface 13 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110, issued to Shepardson et al. in 1962. After exposure drum 12 rotates the electrostatic latent image recorded on the photoconductive surface 13 to development station 19 wherein a conventional developer mix is applied to the photoconductive surface 13 of the drum 12 rendering the latent image visible. A suitable development station is disclosed in U.S. Pat. No. 3,707,947, issued to Reichart in 1973. That patent describes a magnetic brush development system utilizing a magnetizable developer mix having ferromagnetic carrier granules and a toner colorant. The devloper mix is brought through a directional flux field to form a brush thereof, the electrostatic latent image recorded on the photoconductive surface 13 is developed to render it visible by bringing the brush of developer mix into contact therewith.

The developed image on the photoconductive surface 13 is then brought into contact with the sheet 16 of final support material within a transfer station 20 and the toner image is transferred from the photoconductive surface 13 to the contacting side of the final support sheet 16. The final support material may be paper, plastic, etc., as desired.

After the toner image has been transferred to the sheet of final support material 16 the sheet with the image thereon is advanced to a suitable fuser 21 which coalesces the transferred powder image thereto. One type of suitable fuser is described in U.S. Pat. No. 2,701,765, issued to Codichini et al. in 1955. After the fusing process the sheet 16 is advanced to a suitable output device.

Although a preponderance of the toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the surface as it moves through a cleaning station 22. The toner particles may be mechanically cleaned from the photoconductive surface 33 by any conventional means as, for example, the use of a blade as set forth in U.S. Pat. No. 3,740,789, issued to Ticknor in 1973.

It is believed that the foregoing description is sufficient for purposes of the present application to illustrate the general operation of an automatic xerographic copier 11 which can embody the sheet feeding apparatus 10 in accordance with the present invention.

The reproducing machine 11 just described is commonly referred to as a transfer type machine because the image is formed on the drum and then transferred to the copy sheet. The sheet feeding apparatus of this invention, however, is not limited to transfer type machines and could be utilized with xerographic type machines of the Electrofax variety wherein a photoconductive surface such as zinc oxide is coated on the copy sheet and electrostatic imaging and development take place directly on coated surface of the copy sheet. In the Electrofax process there is no need for a cleaning station because the photoconductive surface is not reused or for a transfer station.

The apparatus 10 is also believed applicable to still other types of reproducing machines.

The sheet feeding apparatus 10 of this invention includes a movable member 12 preferably having an imaging surface 13 on its outer periphery. The member 12 includes a cavity 30 and a supply 31 of final support material 16 is supported within the cavity. Means 32 are provided for feeding the final support material from the supply to the imaging surface 13. In the embodiment shown the feeding means 32 comprises a pair of pinch rolls driven by motor M2 through clutch 33. The clutch is selectively actuated during the appropriate sheet feeding interval of drum rotation through a timer 34 to feed a given amount of sheet material from the supply roll 31 outwardly from the cavity 30 into receiver 35 in a given time. The desired sheet length is fed out from the cavity 30 and without severing it from the supply roll 31 it is applied to the surface 13 of the imaging member 12 containing the toner image to be transferred thereto. As the drum continues to rotate in the direction of arrow 15 following sheet feeding, a sheet guide and roller applicator 36 acts upon the sheet to apply it against the surface 13 of the drum. Image transfer is then obtained in the manner previously described by means of a corona generator 20. After image transfer the sheet 16 is severed from the supply roll 31 by a knife 37 actuated by solenoid 38 as the drum reaches the cutting station 39. The severed sheet is then stripped from the drum surface 13 by stripper finger 40 and fed through the fuser 21 to coalesce the image thereto.

Referring now to FIG. 2, there is shown an alternative reproducing apparatus including the sheet feeding apparatus of this invention particularly adapted for forming a duplex copy sheet in a single pass. The duplexing concept shown, namely, flipping the sheet over after transfer of the first image to transfer the second image while securing the trailing edge of the sheet at the drum surface is similar in most respects to that described in the aforenoted North application. It is believed that applying the sheet feeding apparatus of the present invention to a single pass duplexing machine in accordance with North's invention offers several adavantages in that it is not necessary to feed the sheet to the surface of the drum and catch its trail edge in a suitable gripper.

Referring now to FIG. 2, electrostatic images A and B are formed on the imaging surface 13 by moving it through charging station 17 and exposure station 18. At the exposure station 18 the first and second electrostatic images are sequentially formed on the surface of the drum. The images A and B are disposed on opposite sides of the sheet feed rolls 32 and closely adjacent thereto. Any conventional optics system could be utilized for forming the sequential images including, for example, those disclosed in the above-noted North application or in U.S. Pat. No. 3,318,212.

Following the charging and imaging operations the electrostatic images A and B on the surface of the drum are moved past the development station wherein they are rendered visible. The drum 12 continues to rotate and as the sheet feed rolls 32 move past the planatary applicator roll 45 as shown in FIG. 3, the sheet material 16 is fed from the supply roll 31. The length of sheet 16 which is fed out is governed by the feeding time interval which is controlled as shown in FIG. 2 by means of a timer 34 of conventional design which selectively actuates a clutch 33 interposed in the drive between the motor M2 and the feed rolls 32. If different sized sheets are desired all that is necessary is to provide an appropriate time interval for feeding. This may be readily done by conventional means. The sheet of desired length L which is fed off the supply roll 31 has its trailing edge displaced from the nip of the feed rolls 32 so that its trailing edge lines up with the end of the imaging surface for the A image.

Having fed out the desired amount of sheet material 16 it is now necessary to apply the sheet to the surface 13 with the first image B to be transferred thereto.

The application of the sheet to image B may be done in any desired manner. In the apparatus shown a planatary applicator roll 45 is provided which rotates about its roll axis and also travels concentrically with the drum surface 13 in a planatary fashion. The planatary motion of the roll 45 is arranged to be faster than the peripheral speed of the drum 12 so that the roll can overtake the drum rotation and apply the sheet 16 to the drum surface 13. After applicator roll 45 completes its range of planatary motion as shown in FIG. 4, it has a fast return to its original home position (shown in solid lines) to await the feeding of the next copy sheet. If desired, the applicator roll 45 can comprise an electrostatic transfer roll or alternatively a transfer station 20 can be provided comprising a corona generator type transfer device.

Referring now to FIG. 5, the drive mechanism for the planatary applicator roll 45 is hown in greater detail. The applicator roll 45 is supported for movement toward and away from the drum surface 13. It is desirable to withdraw the applicator roll from the drum surface during the time intervals when it is not applying a sheet to that surface, such as when it is flying back or is inoperative, since otherwise it might tend to smear the images A and B. The applicator roll is supported by means of arms 46 which rotate about the drum shaft 14. A solenoid type actuator 50 is utilized to move the roll 45 from its inoperative position wherein it is spaced from the surface 13 of the drum to its operative position where it either engages or is positioned very close to the surface so that it can apply the sheet 16.

The reciprocal planatary drive is provided by means of the motor M3 connected through clutch 47 to drive gear 51 which meshes with a gear portion 52 of the arm 46. A timer 48 as in FIG. 2 selectively actuates the clutch 51 to impart planatary motion to the roll 45 during the appropriate interval of drum rotation. Flyback may be obtained by means of any conventional spring type mechanism (not shown) which operates on the arm 46 when the clutch 47 is disengaged.

As previously noted transfer of the "B" image to the first side of the sheet 16 can then be obtained by means of either a corona generator 20 or by making the applicator roll itself an electrostatic pressure transfer roller.

Following the transfer operation, as shown in FIG. 6, the sheet 16 is stripped from the drum surface 13 by any conventional means as for example by use of a stripper finger 40.

As the sheet is stripped off the surface of the drum, it is fed onto the transport 41 of a radiant type fuser 20' as in FIG. 7 which coalesces the toner image into the sheet. If desired, the fuser 21 can be a low power device which merely serves to tack the image to the sheet so that it will not be disturbed during further processing. Full fusing can then be obtained during the second fusing operation for fusing the "A" image to the second side of the sheet.

Continued rotation of the drum after the first image "B" has been fused to the first side of the sheet 16, causes the sheet to be withdrawn from the fuser 21 as in FIG. 8. The end of the fuser housing operates as an applicator member for applying the second side of the sheet 16 to the image A. Image "A" is then transferred to the second side of the sheet 16 as in FIG. 9 by means of an electrostatic transfer roller or other suitable transfer device.

Referring now to FIG. 10 following transfer of the image to the second side of the sheet, the sheet is severed from the supply roll 31 by any desired means as, for example, a solenoid 38 actuated guillotine type cutter arrangement 37. This specific type of cutter 37 shown does not form a part of the present invention and any desired device for shearing the sheet from the supply roll could be employed, as for example, those shown in U.S. Pat. Nos. 2,518,960 to Tolison; 3,829,208 to Meijel et al.; and 3,639,053 to Spear. By positioning the cutting edge of the shear at the end of the A imaging area the sheet can be imaged right up to the severed edge.

After the sheet 16 has been severed, it is then stripped from the drum surface as in FIG. 11 by means of a conventional stripper finger 40' and fed onto a vacuum transport 41' of a radiant fuser 21' to fully fuse the images to the sheet. The finished copy sheet is then fed out the exit port of the fuser 21' to any desired output device.

In this manner single pass duplexing can be accomplished just as in the aforenoted North application. The use of a paper feeding arrangement 10 in accordance with the present invention eliminates the need to register the sheet with respect to the image on the drum and the need to feed the sheet to the drum in a manner so that its trailing edge can be captured by a suitable gripping mechanism. The use of the remote gripping which is provided by the feed rolls 32 and a sheet cutter at the edge of the imaging area enables the entire surface of the sheet to be imaged. Therefore, in accordance with the present invention a highly reliable sheet handling approach has been utilized for single pass duplexing. The sheet is never severed from the supply roll until the imaging operation has been completed. This, substantially reduces the propensity for jamming, misfeeds, misgripping or other similar types of problems.

The sheet feeding arrangement of this invention has been shown as applied to a machine for forming a copy on a single side of a copy sheet or to a machine for forming images on both sides of a copy sheet in a single pass. It should be apparent that both the single sided copy machine and single pass duplexing machine are adaptable to color processes as are well known in the art as, for example, the process set forth in U.S. Pat. No. 3,799,668 to McVeigh.

Referring now to FIG. 12, there is shown by way of example a xerographic type reproducing machine adapted to transfer a plurality of toner images to a copy sheet. The toner images which are transferred may be of the same color or of differing shades or of differing colors to provide a resulting image of enhanced quality or in multiple colors. The apparatus of FIG. 12 is similar in most respects to that described by reference to FIG. 1 in that it is only adapted to form an image on a single side of a copy sheet.

A color xerographic process is now in commercial use in the Xerox 6500 copier. Because the color process is so well known, only a brief description of it will be given here. To form a full color image it is necessary to pass the imaging surface 13 past the charging 17 exposure 18' and development stations 19' three times and to transfer and fuse three superimposed and registered toner images to the surface of the sheet. Optical filters are selectively employed in order to form three single color separated exposures of the original. Each single color exposure forms what may be termed a single color electrostatic image on the surface of the drum which is then developed by a given colored toner. The development system 19' shown in FIG. 12 comprises three systems 55–57 of the type described by reference to FIG. 1. One is used for each of three different colored toners employed for developing the respective single color electrostatic images.

The operation of the machine of FIG. 12 is as follows. After the first color separation exposure at 18' of charged imaging region A continued rotation of the drum brings the resulting single color electrostatic image A to the development station 55. During the first imaging cycle a sheet is fed out from the cavity 30 of the drum to the desired length and applied to the surface 13 by means of the planatary applicator roller 45'. Image transfer is then obtained by means of the corona generator 20 in the manner previously described. Following transfer the sheet 16 is stripped from the drum surface 13 and the first color image is fused or tacked to the sheet in fuser 21. As the drum 12 continues to rotate the sheet 16 is withdrawn from the fuser 21 and applied against the drum surface. The imaging portion A of the drum surface 13 is then cleaned at 22, charged at 17, exposed again with a suitably color separated image at 18', and developed with a different color toner at 56. When the drum 12 rotates to the position shown in FIG. 12 the applicator roller 45' which has returned to about the 6 o'clock position shown provides stripping of the sheet 16 from the drum surface 13 and reapplication of the sheet to the second developed toner image for image transfer.

It is apparent that for a color system, since multiple passes are required for the drum, the sheet will be flipped over on the drum surface for the second and further reapplications. The third toner image is formed and transferred in substantially the same manner as the second but one utilizing development system 57. Following the transfer of the third image to the sheet 16 of final support material, the sheet is severed from the supply roll 31 and fed off through the fuser 21 to a suitable output device in a manner previously described. The applicator roller 45' system for the apparatus of FIG. 12 is in most respects similar to that described with reference to FIG. 2 with the exception that the roller includes a stripper finger 60.

In this way the sheet feeding apparatus of the present invention can be utilized for maintaining registration of a sheet of final support material. It can do so without the necessity of catching the sheet in a gripper mechanism and without lead edge or trail edge deletions or gripper marks.

The patents and texts referred to specifically in this application are intended to be incorporated by reference into the application.

It is apparent that there has been provided in accordance with this invention a sheet feeding apparatus and reproducing machine which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In a sheet feeding apparatus for a reproducing machine including a movable member having an imaging surface on its outer periphery and a supply of sheet material, the improvement wherein:

said movable member includes a cavity and wherein said supply of sheet material is supported within said cavity;

and wherein said apparatus further includes: means for forming at least one image on said surface;

means for feeding a desired length of sheet material from said supply outwardly of said cavity;

means for applying said sheet material to said imaging surface; and means for transferring said image from said surface to said sheet material.

2. An apparatus as in claim 1, wherein said movable member is rotatable.

3. An apparatus as in claim 2, wherein said movable member comprises a drum-like member and wherein said supply of sheet material is in roll form and said apparatus further includes means for severing said sheet material from said roll.

4. An apparatus as in claim 1, wherein said image forming means includes means for forming sequentially on said surface first and second images and wherein said transferring means further includes means for transferring sequentially said first and second images to a first and an opposing side of said sheet before said sheet is severed from said roll.

5. An apparatus as in claim 1, wherein said image forming means includes means for forming sequentially on said surface a plurality of images and wherein said transferring means includes means for transferring sequentially said plurality of images to a side of said sheet in superimposed registration before said sheet is severed from said roll.

6. An apparatus as in claim 1, wherein said feeding means includes means for controlling the length of sheet material fed from said supply roll.

7. An apparatus as in claim 1, wherein said applying means comprises at least one roll arranged to selectively engage said sheet against said surface, said roll being arranged to travel in a planetary fashion relative to said surface in the same direction in which said surface is moving.

8. An apparatus as in claim 7, wherein said roll comprises an electrostatic transfer roll.

9. An apparatus as in claim 1, wherein said surface comprises a photoconductive surface and said image forming means comprises means for charging said surface; means for exposing said surface to a light image for forming a corresponding electrostatic image on said surface and means for developing said electrostatic image to render it visible.

10. A sheet feeding process for a reproducing machine comprising the steps of:

providing a movable member having an imaging surface on its outer periphery;

providing a supply of sheet material supported within a cavity in said member;

forming at least one image on said surface;

feeding a desired length of said sheet material from said supply thereof outwardly of said cavity;

applying said sheet material to said sheet receiving surface; and transferring said image from said surface to said sheet material.

11. A process as in claim 10, wherein said sheet supply is in roll form and further including the steps of rotating said member and severing said sheet from said roll.

12. A process as in claim 11 further including the steps of forming sequentially on said surface first and second images and transferring sequentially said first and second images to a first and an opposing side of said sheet before said sheet is severed from said roll.

13. A process as in claim 11, further including the steps of forming sequentially on said surface a plurality of images and transferring sequentially said plurality of images to a side of said sheet in superimposed registration before said sheet is severed from said roll.

14. A process as in claim 11, further including the step of controlling the length of sheet material fed from said supply roll.

15. A process as in claim 10, wherein said imaging surface comprises a photoconductive surface and wherein said image forming step comprises the steps of charging said surface; exposing said surface to a light image to form a corresponding electrostatic image on said surface; and developing said electrostatic image to render it visible.

* * * * *